US008690313B2

(12) United States Patent
Yamanobe

(10) Patent No.: US 8,690,313 B2
(45) Date of Patent: Apr. 8, 2014

(54) CONVEYING DEVICE AND IMAGE FORMING APPARATUS

(75) Inventor: Jun Yamanobe, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 188 days.

(21) Appl. No.: 13/334,058

(22) Filed: Dec. 22, 2011

(65) Prior Publication Data

US 2012/0188318 A1 Jul. 26, 2012

(30) Foreign Application Priority Data

Jan. 25, 2011 (JP) ..... 2011-013316

(51) Int. Cl.
*B41J 2/01* (2006.01)

(52) U.S. Cl.
USPC ..... 347/102; 347/104

(58) Field of Classification Search
USPC ..... 347/88, 99, 101–104; 271/3.14
IPC ..... B41J 2/01
See application file for complete search history.

(56) References Cited

U.S. PATENT DOCUMENTS

2007/0103534 A1* 5/2007 Shinohara et al. ..... 347/104
2007/0195126 A1* 8/2007 Kusunoki ..... 347/54
2009/0244237 A1* 10/2009 Kachi ..... 347/102
2010/0053291 A1* 3/2010 Yoda ..... 347/102
2010/0213165 A1* 8/2010 Anderson et al. ..... 216/27

FOREIGN PATENT DOCUMENTS

JP 8-192935 7/1996
JP 9-175685 A 7/1997
JP 2007-119215 5/2007

OTHER PUBLICATIONS

Partial English language translation of the following: Office action dated Jul. 2, 2013 from the Japanese Patent Office in a Japanese patent application corresponding to the instant patent application. This office action translation is submitted now in order to supplement the understanding of patent document JP8-192935 and JP2007-119215 which are cited in the office action and are being disclosed in the instant Information Disclosure Statement.

* cited by examiner

*Primary Examiner* — Manish S Shah
*Assistant Examiner* — Roger W Pisha, II
(74) *Attorney, Agent, or Firm* — SOLARIS Intellectual Property Group, PLLC

(57) ABSTRACT

A conveying device comprising a conveying body that conveys a recording medium; and a press roller comprising a large diameter portion that is formed at an axial direction central portion of the press roller and makes contact with the conveying body, and small diameter portions formed at both axial direction sides of the large diameter portion with a smaller diameter than the large diameter portion. Only a width direction central portion of the recording medium is pressed against the conveying body by the large diameter portion.

13 Claims, 7 Drawing Sheets

CONVEYING DEVICE AND IMAGE FORMING APPARATUS

CROSS-REFERENCE TO RELATED APPLICATION

This application is claims priorities under 35 USC 119 from Japanese Patent Application No. 2011-013316 filed on Jan. 25, 2011, the disclosure of which is incorporated by reference herein.

BACKGROUND OF THE INVENTION

1. Technical Field

The present invention relates to a conveying device and an image forming apparatus.

2. Related Art

An image forming apparatus is known that conveys a recording medium, such as paper, and jets ink droplets onto the recording medium using an inkjet recording head.

In such an image forming apparatus it is necessary to have a small separation distance between the recording medium and the inkjet recording head (for example maintain the separation distance at about 1 mm or less). Consequently, a mechanism is required for retaining the recording medium on a conveying unit (such as a belt or drum), particularly when forming images at high speed.

However, problems of paper deformation (curl) arise when paper that is not of inkjet-specification, such as ordinary coated printing paper and standard plain paper, is employed as the recording medium in an inkjet recording apparatus, and in particular when an ink with water as a solvent is jetted.

Obviously curl is detrimental to output product quality, however there is also the possibility that minute undulations, at a level not discernible by user eye, that occurred when printing the front face subsequently result in the generation of large creases at a tail portion (trailing edge portion) of the paper when printing the back face of the paper. Such creases arise when the paper is restrained by rollers and the undulations are pressed towards and fixed to the surface of the tail portion of the paper adhered the conveying unit.

An image forming apparatus equipped with a press roller for restraining paper is described in Japanese Patent Application Laid-Open (JP-A) No. 9-175685. A configuration is described for the image forming apparatus in which the central portion of paper is pressed harder than the two edge portions due to the central portion of the press roller being fatter than the two end portions, so as not to induce waviness (creasing).

However, when the method of the above document is applied for conveying a paper with a reverse-face thereof facing upward after an image has already been formed on a front-face of the paper by inkjet heads on large size paper (for example Half Kiku size (636 mm×469 mm) or B2 size paper), it is known that the two end portions of the press roller still press the paper, even if only weakly (see paragraph number [0025]), resulting in creases being induced at the central portion of the paper.

SUMMARY

In consideration of the above circumstances, the present invention provides a conveying device and an image forming apparatus capable of stably conveying a recording medium, even when conveying the recording medium with the printed front-face thereof facing down after an image has been formed by jetting liquid droplets, and capable of suppressing generation of wrinkles and creases in the recording medium.

A conveying device of a first aspect of the present invention is a conveying device including: a conveying body that conveys a recording medium; and a press roller including a large diameter portion that is formed at an axial direction central portion of the press roller and makes contact with the conveying body, and small diameter portions that are formed at both axial direction sides of the large diameter portion with a smaller diameter than the large diameter portion, wherein only a width direction central portion of the recording medium is pressed against the conveying body by the large diameter portion.

According to the first aspect, the press roller includes the large diameter portion formed at an axial direction central portion and the small diameter portions formed at both axial direction sides of the large diameter portion, and only the width direction central portion of the recording medium is pressed against the conveying body by the large diameter portion. Accordingly, only the width direction central portion of the recording medium is nipped by the large diameter portion of the press roller, and the two width direction edge portions of the recording medium are not nipped. Undulations in the recording medium are thereby pressed out towards the small diameter portion sides of the press roller.

Consequently, the recording medium can be stably conveyed even when a reverse-face of the recording medium faces upward after an image has been formed on a front-face of the recording medium by jetting liquid droplets, and wrinkles and creases can be suppressed from occurring in the recording medium.

A conveying device of a second aspect of the present invention is the conveying device of the first aspect wherein the conveying device is capable of conveying plural recording media of different widths and satisfies $0.2\times LM \leq a \leq 0.6\times Lm$, wherein LM is the maximum width of the recording media, Lm is the minimum width of the recording media, and a is the width of the large diameter portion.

According to the second aspect, due to satisfying $0.2\times LM \leq a \leq 0.6\times Lm$, even when plural recording media of different widths are conveyed, by pressing each of the recording media against the conveying body with the large diameter portion of the press roller, undulations in the recording medium are pressed out towards the small diameter portion sides of the press roller, and wrinkles and creases can be efficiently suppressed from occurring in the recording medium.

An image forming apparatus of a third aspect of the present invention is an image forming apparatus including: the conveying device of the first aspect or the second aspect of the present invention; a liquid droplet jetting head that is provided at the recording medium conveying direction downstream side of the press roller and jets liquid droplets from plural jetting ports towards the recording medium being conveyed by the conveying body; and an image conversion section that converts input data of an image into output data. The image forming apparatus satisfies $0<d<Td$, wherein Td is the separation distance between the liquid droplet jetting face of the liquid droplet jetting head and the recording medium and d is the gap between the small diameter portion and the recording medium on the conveying device.

According to the third aspect, the liquid droplet jetting face of the liquid droplet jetting head is provided at the recording medium conveying direction downstream side of the press roller. The image forming apparatus satisfies $0<d<Td$, wherein Td is the separation distance between the liquid droplet jetting face of the liquid droplet jetting head and the recording medium and d is the gap between the small diameter portion of the press roller and the recording medium on the conveying device. Accordingly the liquid droplet jetting face of the liquid droplet jetting head can be prevented from making contact with the recording medium.

An image forming apparatus of a fourth aspect of the present invention is the image forming apparatus of the third aspect wherein the conveying body is equipped with a suction device that suctions a surface of the recording medium.

According to the fourth aspect, the conveying body is equipped with a suction device that suctions a surface of the recording medium, enabling the recording medium to be suppressed from lifting up from the conveying body.

An image forming apparatus of a fifth aspect of the present invention is the image forming apparatus of the third aspect or the fourth aspect further including a processing liquid application device that, before the liquid droplets are jetted onto the recording medium by the liquid droplet jetting head, applies to the recording medium a processing liquid that reacts with a component in the liquid droplets.

According to the fifth aspect, applying a processing liquid that reacts with a component in the liquid droplets to the recording medium before the liquid droplets are jetted onto the recording medium by the liquid droplet jetting head enables bleeding of the liquid droplets jetted onto the recording medium and interference between the liquid droplets themselves to be suppressed.

An image forming apparatus of a sixth aspect of the present invention is the image forming apparatus of the fifth aspect further including a processing liquid drying device that dries a solvent component of the processing liquid in the interval between when the processing liquid is applied by the processing liquid application device and when the liquid droplets are jetted onto the recording medium by the liquid droplet jetting head.

According to the sixth aspect, by drying the solvent component of the processing liquid in the interval between when the processing liquid is applied and when the liquid droplets are jetted onto the recording medium, the processing liquid at the width direction central portion of the recording medium can be suppressed from being transferred onto the large diameter portion of the press roller when the large diameter portion of the press roller nips the recording medium.

An image forming apparatus of a seventh aspect of the present invention is the image forming apparatus of the sixth aspect wherein the processing liquid drying device is configured to dry the width direction central portion of the recording medium more than the two width direction edge portions of the recording medium.

According to the seventh aspect, by drying the width direction central portion of the recording medium more than the two width direction edge portions of the recording medium, the processing liquid at the width direction central portion of the recording medium can be efficiently suppressed from being transferred onto the large diameter portion of the press roller.

An image forming apparatus of an eighth aspect of the present invention is the image forming apparatus of any one of the fifth aspect to the seventh aspect wherein different conversion processing is performed by the image conversion section for a region of the central portion of the recording medium pressed by the large diameter portion to conversion processing performed for regions of the two edge portions of the recording medium not pressed by the large diameter portion.

According to the eighth aspect, even in cases in which the degree of reaction of the liquid droplets differs at the central portion region of the recording medium pressed by the large diameter portion of the press roller to the degree of reaction at the two edge portion regions of the recording medium not pressed by the large diameter portion, resulting in the degree of dot spread differing, visibility of unevenness in an image can be reduced therebetween by different conversion processing being performed in the image conversion section for the central portion region to conversion processing performed for the two edge portion regions of the recording medium.

An image forming apparatus of a ninth aspect of the present invention is the image forming apparatus of the eighth aspect wherein the image conversion section performs conversion processing such that a liquid droplet amount jetted by the liquid droplet jetting head at the central portion region is smaller than a liquid droplet amount jetted by the liquid droplet jetting head at the two edge portion regions.

According to the ninth aspect, visibility of unevenness in an image can be efficiently reduced by the image conversion section setting the liquid droplet amount jetted by the liquid droplet jetting head at the central portion region smaller than the liquid droplet amount jetted by the liquid droplet jetting head at the two edge portion regions.

An image forming apparatus of a tenth aspect of the present invention is the image forming apparatus of any one of the fifth aspect to the seventh aspect wherein jetting energy for jetting liquid droplets from the liquid droplet jetting head is different at the central portion region of the recording medium pressed by the large diameter portion than that at the two edge portion regions of the recording medium not pressed by the large diameter portion.

According to the tenth aspect even in cases in which the degree of reaction of the liquid droplets differs at the central portion region of the recording medium pressed by the large diameter portion of the press roller to the degree of reaction at the two edge portion regions of the recording medium not pressed by the large diameter portion, resulting in the degree of dot spread differing therebetween, visibility of unevenness in an image can be reduced therebetween by setting the jetting energy for jetting liquid droplets from the liquid droplet jetting head different at the central portion region to at the two edge portion regions.

An image forming apparatus of an eleventh aspect of the present invention is the image forming apparatus of the tenth aspect wherein the liquid droplet jetting head uses a jetting energy for liquid droplets at the central portion region smaller than the jetting energy for liquid droplets at the two edge portion regions.

According to the eleventh aspect visibility of unevenness in an image can be efficiently reduced by the liquid droplet jetting head using a jetting energy for liquid droplets at the central portion region smaller than the jetting energy for liquid droplets at the two edge portion regions.

An image forming apparatus of a twelfth aspect of the present invention is the image forming apparatus of any one of the fifth aspect to the seventh aspect wherein a diameter of a liquid droplet jetting port of the liquid droplet jetting heads is different at the central portion region of the recording medium pressed by the large diameter portion from at the two edge portion regions of the recording medium not pressed by the large diameter portion.

According to the twelfth aspect even in cases in which the degree of reaction of the liquid droplets differs at the central portion region of the recording medium pressed by the large diameter portion of the press roller to the degree of reaction at the two edge portion regions of the recording medium not pressed by the large diameter portion, resulting in the degree of dot spread differing therebetween, visibility of unevenness in an image can be reduced therebetween by the diameter of the jetting ports of the liquid droplet jetting heads being set different at the central portion region to at the two edge regions.

An image forming apparatus of a thirteenth aspect of the present invention is the image forming apparatus of the twelfth aspect wherein the liquid droplet jetting heads use a smaller diameter for the jetting ports for jetting liquid droplets onto the central portion region than the diameter of the jetting ports for jetting liquid droplets onto the two edge portion regions.

According to the thirteenth aspect, visibility of unevenness in an image can be efficiently reduced by the liquid droplet jetting head using a smaller diameter of the jetting ports for jetting liquid droplets at the central region to the diameter of the jetting ports for jetting liquid droplets at the two edge regions.

An image forming apparatus of a fourteenth aspect of the present invention is the image forming apparatus of the twelfth aspect or the thirteenth aspect wherein the liquid droplet jetting head is configured with capability to selectively switch between large diameter jetting ports and small diameter jetting ports.

According to the fourteenth aspect, when plural recording media of different widths are conveyed, the size of liquid droplets can be changed by selectively switching between larger diameter jetting ports and smaller diameter jetting ports according to the width of the recording medium.

Due to configuring as described above, the present invention can accordingly stably convey a recording medium and suppress wrinkles and creases from occurring in the recording medium even when the recording media is conveyed while reverse-face faces upward after liquid droplets have been jetted on the front face of the recording media and an image formed.

DETAILED DESCRIPTION OF THE INVENTION

Explanation follows regarding an example of an exemplary embodiment of the present invention, with reference to the drawings.

Overall Configuration

Figure 1:
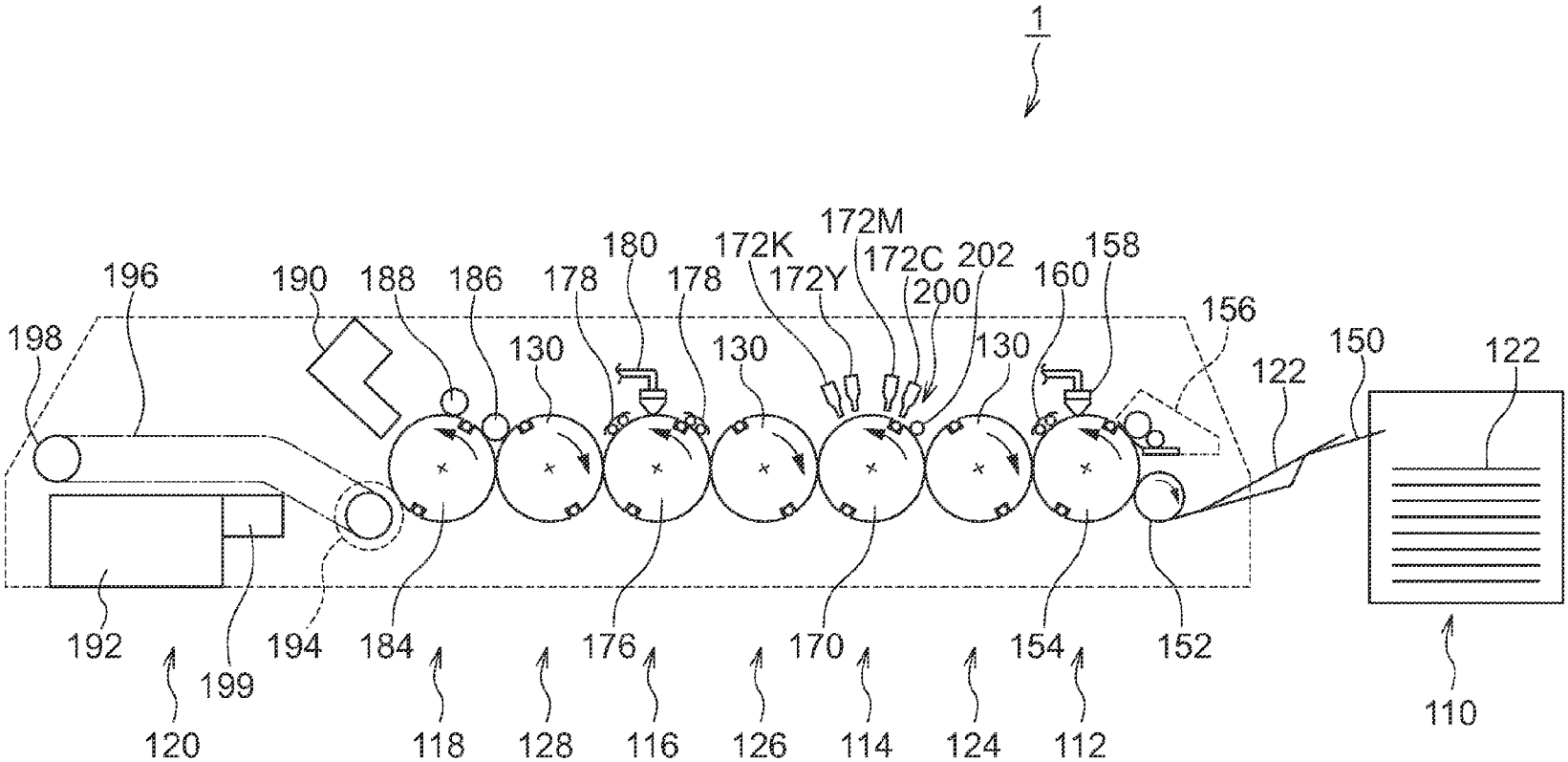
FIG. 1 is a schematic diagram illustrating an overall configuration of an image forming apparatus according to an exemplary embodiment of the present invention.
Figure 2:
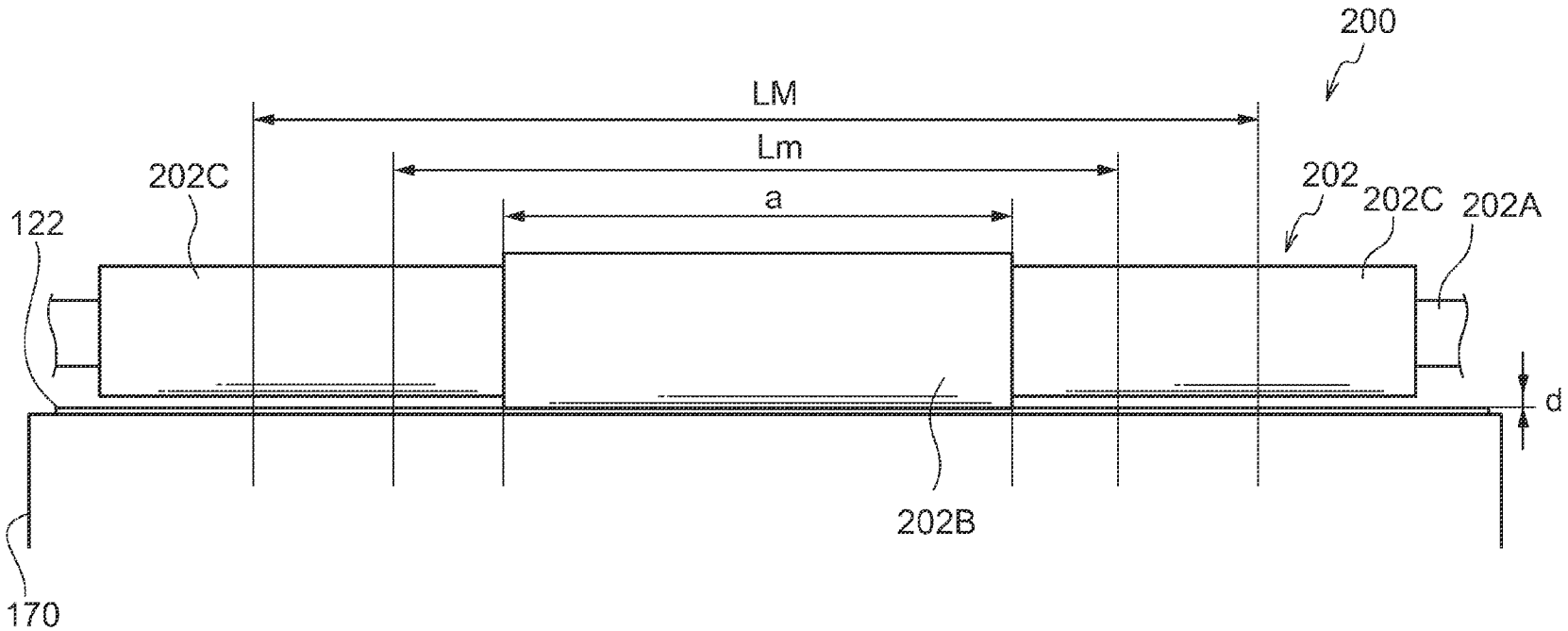
FIG. 2 is a configuration diagram illustrating the vicinity of contact portions between a press roller employed in an image forming apparatus according to an exemplary embodiment of the present invention and a recording medium.

Explanation follows regarding an example of a configuration of an inkjet image forming apparatus for implementing the conveying device and the image forming apparatus of the present invention, with reference to FIG. 1 and FIG. 2. FIG. 1 is a schematic diagram (side view) illustrating the apparatus overall, and FIG. 2 is a configuration diagram focusing on a press roller.

An inkjet recording apparatus 1 utilizes an impression cylinder direct rendering method to form a desired color image by jetting plural colors of ink (liquid droplets) from inkjet heads 172M, 172K, 172C, 172Y, serving as examples of liquid droplet jetting heads, onto paper 122 retained on an impression cylinder (image rendering drum 170) in an image rendering section 114. The inkjet recording apparatus 1 is an on-demand type of image forming apparatus in which a two liquid reaction (aggregation) method is applied for forming images on the paper 122, by applying a processing liquid (ink aggregation processing liquid) onto the paper 122 serving as the recording medium prior to ink jetting so as to cause the processing liquid to react with the ink.

The inkjet recording apparatus 1 is configured with main sections including a paper feed section 110, a processing liquid application section 112, the image rendering section 114, a drying section 116, a fixing section 118, and a paper discharge section 120.

The paper feed section 110 is a mechanism for supplying the paper 122 into the processing liquid application section 112. The sheet-form paper 122 is stacked in the paper feed section 110. A paper feed tray 150 is provided to the paper feed section 110, and the paper 122 is fed out one sheet at a time from the paper feed tray 150 into the processing liquid application section 112. Plural types of paper 122 with differing paper type and size can be used in the inkjet recording apparatus 1. In the present exemplary embodiment explanation is given of a case in which sheet-form paper (cut paper) is employed as the paper 122.

The processing liquid application section 112 is a mechanism for applying a processing liquid to the recording face of the paper 122. The processing liquid contains a component for causing coloring matter (pigment or dye) in ink applied in the image rendering section 114 to aggregate and/or increase in viscosity. Separation of coloring matter and solvent in the ink is promoted by such contact between the processing liquid and the ink.

Specific methods for causing aggregation and/or increase in viscosity of the coloring matter include employing a processing liquid that reacts with ink and causes coloring matter in the ink to be precipitated out or become insoluble, and a processing liquid that causes generation of a semi-solid substance (gel) containing the coloring matter in the ink. Examples of mechanisms by which reactions are caused to occur between the ink and the processing liquid include: a method in which an anionic coloring matter in the ink is caused to react with a cationic chemical compound in the processing liquid; a method in which the pH of an ink is changed by mixing together the ink and a processing liquid, having different pH's from each other, disrupting dispersion of pigment in the ink and causing the pigment to aggregate; and a method in which dispersion of pigment in the ink is disrupted by reaction with a multi-valent metal salt in the processing liquid, causing the pigment to aggregate.

Methods for applying the processing liquid include droplet spotting with an inkjet head, coating using a roller, and uniform application using a spray.

As shown in FIG. 1, the processing liquid application section 112 includes a paper feed cylinder 152, a processing liquid drum 154 and a processing liquid coating device 156 serving as an example of a processing liquid application device. The processing liquid drum 154 retains the paper 122 and conveys the paper 122 by rotation. The processing liquid drum 154 is equipped with claw shaped retaining members (clippers) on the outer peripheral face of the processing liquid drum 154, such that the leading edge of the paper 122 can be retained by nipping the paper 122 between the claws of the retaining members and the peripheral face of the processing liquid drum 154.

Configuration may be made such that suction holes are provided on the outer peripheral face of the processing liquid drum 154 and connected to a suction mechanism to suction from the suction holes. The paper 122 can thereby be retained in close contact to the peripheral face of the processing liquid drum 154.

The processing liquid coating device 156 is provided at the outside of the processing liquid drum 154, facing towards the peripheral face of the drum 154. The processing liquid coating device 156 is configured with a processing liquid container in which processing liquid is stored, an anilox roller disposed so as to be partly immersed in the processing liquid of the processing liquid container, and a rubber roller for pressing against the anilox roller and the paper 122 on the processing liquid drum 154 and transferring the processing liquid onto the paper 122 after metering the processing liquid. By using the processing liquid coating device 156 the processing liquid can be applied to the paper 122 while metering. A hot air heater 158 and IR (infrared) heaters 160, serving as an example of a processing liquid drying device, are provided for drying the processing liquid coated on the paper 122 at the paper 122 conveying direction downstream side of the processing liquid coating device 156.

In order to avoid coloring matter float (a phenomenon in which ink liquid droplets float on the processing liquid and do not form dots at their intended positions), drying of solvent components in the processing liquid is performed with the hot air heater 158 and the IR heaters 160 after processing liquid droplet spotting.

The paper 122 to which the processing liquid has been applied is then passed across from the processing liquid drum 154 to the image rendering drum 170 of the image rendering section 114 via an intermediate conveying section 124 (a passing cylinder 130). The image rendering section 114 is provided with a conveying device 200 equipped with the image rendering drum 170 serving as an example of a conveying body for conveying the paper 122, and a press roller 202 for pressing the paper 122 onto the image rendering drum 170. The inkjet heads 172M, 172K, 172C, 172Y are disposed in the image rendering section 114 at the paper 122 conveying direction downstream side of the press roller 202. Similarly to the processing liquid drum 154, claw shaped retaining members (clippers) are also provided at the outer peripheral face of the image rendering drum 170. The paper 122 retained on the image rendering drum 170 is conveyed with the recording face facing towards the outside, the paper 122 is pressed against the image rendering drum 170 by the press roller 202 and then ink is applied to the recording face of the paper 122 by the inkjet heads 172M, 172K, 172C, 172Y. An explanation of details regarding the press roller 202 is given later.

Each of the inkjet heads 172M, 172K, 172C, 172Y is a recording head for performing full-line inkjet recording, and has a length corresponding to the maximum width of the image forming region on the paper 122. Nozzles (jetting ports) for ink jetting are disposed in an array of plural nozzle rows on the ink jetting face of each of the inkjet heads 172M, 172K, 172C, 172Y so as to span across the entire width of the image forming region. Each of the inkjet heads 172M, 172K, 172C, 172Y is disposed so as to extend in a direction orthogonal to the paper 122 conveying direction (orthogonal to the image rendering drum 170 rotation direction).

While not shown in the drawings, the outer peripheral face of the image rendering drum 170 is provided with suction holes, connected to a suction device for suctioning the paper 122 through the suction holes. The paper 122 is thereby suctioned onto the peripheral face of the image rendering drum 170 and the paper 122 can be retained in close contact with the peripheral face of the image rendering drum 170.

Liquid droplets of corresponding colors of ink are jetted from each of the inkjet heads 172M, 172K, 172C, 172Y facing towards the recording face of the paper 122 that has been retained in close contact on the image rendering drum 170. Accordingly, the ink makes contact with the processing liquid pre-applied to the recording face in the processing liquid application section 112, aggregating pigment and resin particles dispersed in the ink and forming aggregated bodies. Such problems as pigment run on the paper 122 are thereby avoided, and an image is formed on the recording face of the paper 122.

The paper 122 that has been formed with an image in the image rendering section 114 is passed from the image rendering drum 170 via an intermediate conveying section 126 to a drying drum 176 of the drying section 116. The drying section 116 is a mechanism for drying solvent in the ink, namely moisture included in solvent that has been separated by the aggregation action. The overall drying mechanism is configured from two drying mechanisms: (1) a drying mechanism from the opposite side of the paper 122 to the recording face; and (2) a drying mechanism from the recording face side. Examples of configurations that may be employed for the drying mechanism (1) include pressing a heated member onto the paper 122 from the opposite side of the paper 122 to the recording face and thereby supplying heat through contact thermal transmission. Examples of configurations that may be employed for the drying mechanism (2) include blowing hot air from the recording face side of the paper 122. In addition, heat is supplied by radiation such as from a carbon heater or a halogen heater.

Preferably the residual moisture content from ink moisture after drying is from 1 $g/m^2$ up to, but not including, 3.5 $g/m^2$. If 3.5 $g/m^2$ or more moisture is allowed to remain then off-set onto fixing rollers 186, 188, described later, occurs. However, to achieve less than 1 $g/m^2$ remaining requires moisture that has penetrated within the paper 122 to also be evaporated, requiring a great amount of energy.

As shown in FIG. 1, the drying section 116 of the present exemplary embodiment is equipped with the drying drum 176, plural IR (infrared) heaters 178 and a hot air heater 180 disposed between the IR heaters 178.

Similarly to the processing liquid drum 154, the outer peripheral face of the drying drum 176 is equipped with claw shaped retaining members (clippers) such that the leading edge of the paper 122 is retained by the retaining members. The temperature and flow rate of the hot air blown from the hot air heater 180 towards the paper 122, and the temperature of each of the IR heaters 178 is detected by a temperature sensor, and transmitted as temperature data to a control section, not shown in the drawings. The control section achieves various drying conditions by appropriately adjusting the temperature and flow rate of the hot air and the temperature of each of the IR heaters 178 based on the temperature data.

The surface temperature of the drying drum 176 is preferably set so as to be, for example, 50° C. or greater using an internal heating member (such as a heater). Drying from the back face of the paper 122 is promoted by performing such heating, and image breakdown can be prevented from occurring during fixing. There are no particular limitations with respect to an upper limit to the surface temperature of the drying drum 176, however setting at 75° C. or less is preferable (60° C. or less is more preferable) from the perspective of safety during maintenance operations such as cleaning ink that has adhered to the surface of the drying drum 176 (preventing burns of a maintenance staff due to high temperature).

As described above, it is found that the higher the drying cylinder temperature (the surface temperature of the drying drum 176) the less expansion and contraction occurs in the paper 122, and so setting the surface temperature of the drying drum 176 at a level as high as possible without impinging on safety enables the effect of curl to be suppressed or to be lessened.

Retaining the paper 122 on the outer peripheral face of the drying drum 176 such that the recording face is facing towards the outside (namely such that the recording face is in a curved state on the convex side of the paper 122) and drying while conveying enables creases and lifting up of the paper 122 to be prevented from occurring, and also enables uneven drying caused by these factors to be prevented.

The paper 122 that has been subjected to drying processing in the drying section 116 is passed across from the drying drum 176 to a fixing drum 184 in the fixing section 118 via an intermediate conveying section 128. The fixing section 118 is configured including the fixing drum 184, a first fixing roller 186, a second fixing roller 188 and an in-line sensor 190.

Similarly to the processing liquid drum 154, the outer peripheral face of the fixing drum 184 is equipped with claw shaped retaining members (clippers) such that the leading edge of the paper 122 can be retained by the retaining members. The recording face of the paper 122 is conveyed so as to face towards the outside by rotation of the fixing drum 184. The recording face is subjected to fixing processing by the first fixing roller 186 and the second fixing roller 188, and scanning is performed to the recording face with the in-line sensor 190.

The first fixing roller 186 and the second fixing roller 188 fuse resin particles in the ink (in particular self-dispersing polymer particles) and form a skin on the ink by heating and pressing the ink, and are hence configured so as to heat and press the paper 122.

Specifically, the first fixing roller 186 and the second fixing roller 188 are disposed so as to make press contact with the fixing drum 184, so as to configure nip rollers together with the fixing drum 184. Fixing processing is accordingly performed with the paper 122 nipped with a specific nip pressure (for example 0.3 MPa) between the first fixing roller 186 and the fixing drum 184 and between the second fixing roller 188 and the fixing drum 184.

The first fixing roller 186 and the second fixing roller 188 are configured with a halogen lamp incorporated in a pipe made of a metal with good thermal transmission properties, such as aluminum, and are controlled to a specific temperature (for example 60 to 80° C.).

Thermal energy is imparted by heating the paper 122 with the heating rolls to achieve the Tg (glass transmission temperature) or more of the resin particles (latex) included in the ink, thereby melting the resin particles, performing fixing by pressing into undulations of the paper 122 as well as leveling undulations on the image surface to obtain glossy images.

The in-line sensor 190 is a measuring instrument for detecting a check pattern and measuring such factors as the moisture content, the surface temperature and glossiness with respect to the images fixed to the paper 122, and a CCD line sensor or the like may be applied.

By using the fixing section 118, the resin particles in the image layer in the thin film formed by the drying section 116 are fused by heating and pressing by the fixing rollers 186, 188 to enable fixing to the paper 122. The surface temperature of the fixing drum 184 is also set at 50° C. or greater and drying is promoted by heating the back face of the paper 122 retained on the outer peripheral face of the fixing drum 184, enabling image breakdown during fixing to be prevented, and enabling image strength to be raised due to the effect of raising the temperature of the image.

The paper discharge section 120 is provided at the recording medium conveying direction downstream side of the fixing section 118. The paper discharge section 120 is equipped with a discharge tray 192. A passing cylinder 194, a conveyor belt 196 and a tensioning roller 198 are provided between the discharge tray 192 and the fixing drum 184 of the fixing section 118. The paper 122 is fed to the conveyor belt 196 by the passing cylinder 194 and discharged into the discharge tray 192.

Cooling air ejection nozzles 199 are provided adjacent to the discharge tray 192 with configuration made such that cooling of the paper 122 can be performed by blowing with cooling air from the cooling air ejection nozzles 199.

While not illustrated in FIG. 1, in addition to the configuration described above the inkjet recording apparatus 1 is also provided with: ink storage tanks for supplying ink to each of the inkjet heads 172M, 172K, 172C, 172Y; a mechanism for supplying processing liquid to the processing liquid application section 112; a head maintenance section for performing cleaning of the inkjet heads 172M, 172K, 172C, 172Y (such as subjecting the nozzle face to wiping, purging, nozzle suctioning); a position detection sensor for detecting the position of the paper 122 on the medium conveying path; and temperature sensors for detecting the temperature of each apparatus section.

With the inkjet recording apparatus 1 illustrated in FIG. 1 configuration may also be made with plural seasoning device tables for use at the discharge tray 192, in a configuration such that each of the seasoning devices can be moved between the paper discharge section 120 and the paper feed section 110.

The present exemplary embodiment is also configured for forming images on both sides of the paper 122 (double-sided printing). Methods for such double-sided printing include: (1) a method of printing a first face of the paper 122, then reversing the front and back sides of the paper 122 and passing the paper 122 through a similar inkjet recording apparatus to print the second face of the paper 122; (2) a method of printing a first face of the 122, then reversing the front and back sides of the paper 122 using a not illustrated conveying section, returning the paper 122 to the stack position (the paper feed section 110 in the inkjet recording apparatus 1 illustrated in FIG. 1) and then printing the second face of the paper 122; and (3) a method of printing a first face of the paper 122, then employing a user to reverse the front and back sides of the paper 122 before placing the paper 122 back again in the stack position (the paper feed section 110 of the inkjet recording apparatus 1 illustrated in FIG. 1). In (3) a configuration is preferably adopted in which a user indicates through a PC interface whether printing is to be on the first face or the second face of the paper 122.

Details of the Conveying Device 200

The conveying device 200 is, as described above, provided with the image rendering drum 170 for conveying the paper 122 and the press roller 202 for pressing the paper 122 against the image rendering drum 170. As shown in FIG. 2, the press roller 202 is equipped with a rotation shaft 202A, a large diameter portion 202B formed with a large diameter at an axial direction central portion of the rotation shaft 202A; small diameter portions 202C formed with smaller diameters than the large diameter portion 202B at the two axial direction sides of the large diameter portion 202B. The press roller 202 is provided in a position so as to make contact through the paper 122 with the image rendering drum 170. Only the width direction central portion of the paper 122 is pressed by the large diameter portion 202B against the image rendering drum 170. Namely, the press roller 202 only nips the width direction central portion of the paper 122 with the large diameter portion 202B at the axial direction central portion of the press roller 202, and the paper 122 is not pressed (not nipped) by the small diameter portions 202C at the two axial direction ends of the press roller 202. The press roller 202 is configured so as to follow the rotation of the image rendering drum 170 on which the paper 122 is retained.

In the image rendering section 114 the inkjet heads 172M, 172K, 172C, 172Y are provided at the paper 122 conveying direction downstream side of the press roller 202. The paper 122 that has been pressed against the image rendering drum 170 by the press roller 202 is conveyed to a position facing the inkjet heads 172M, 172K, 172C, 172Y.

Small Diameter Portions 202C of the Press Roller 202 and Gap d As shown in FIG. 2, when the press roller 202 is set in place, a gap is maintained in the conveying device 200 between the small diameter portions 202C at the axial direction two ends of the press roller 202 and the paper 122. The gap is not only determined simply by the design of the press roller 202, and also depends on such factors as the nip pressure when setting the image rendering drum 170 to the paper 122 and any bowing of the press roller 202 toward the paper 122 (the amount of deformation of the press roller 202). The gap d between the small diameter portions 202C of the press roller 202 and the paper 122 is preferably set so as to satisfy the following formula (1).

$$0<d<Td \qquad \text{Formula (1)}$$

In the above, Td is the separation distance between the ink jetting face of the inkjet heads 172M, 172K, 172C, 172Y and the front face of the paper 122, a quantity referred to as the throw distance. By satisfying Formula (1), even in cases when the paper 122 lifts up by Td or greater, such lifting is depressed inwards (leveled out) by the two width direction edge portions of the paper 122 passing in a non-nipped state through the gap d that is smaller than the throw distance Td.

Figure 3:
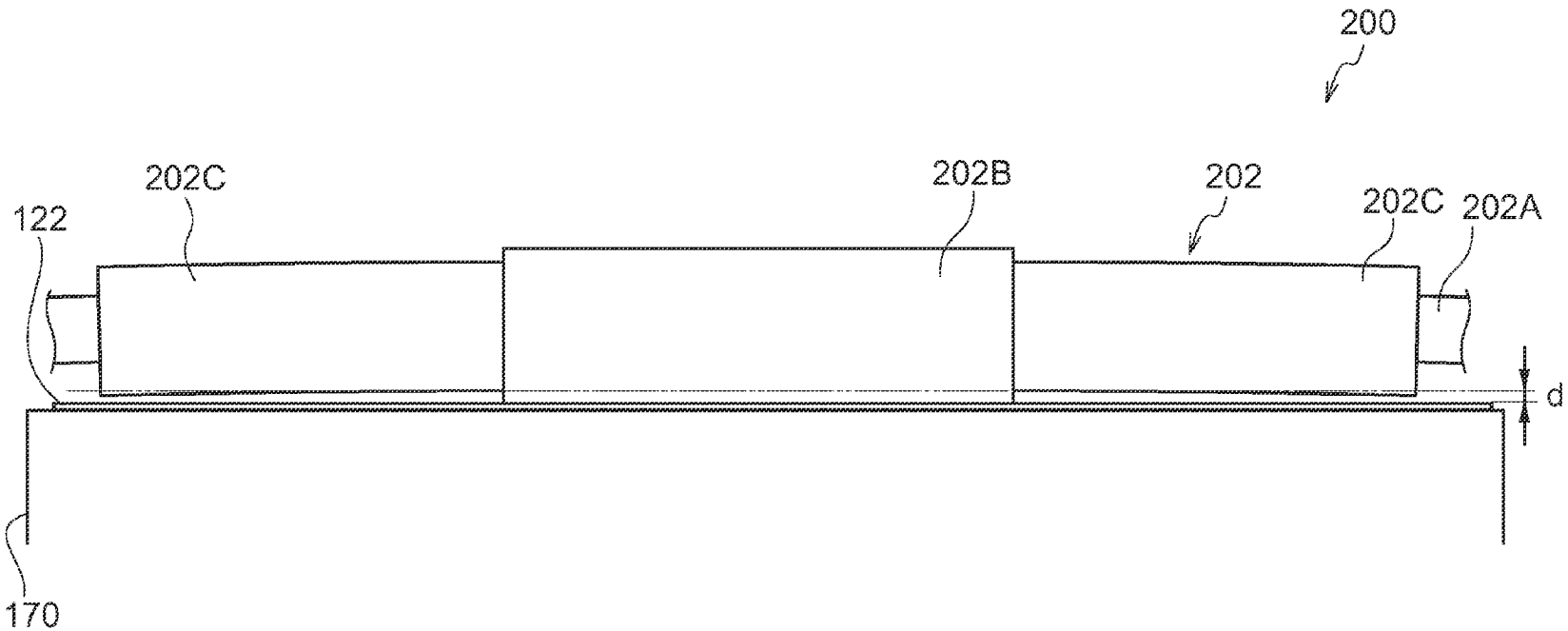
FIG. 3 is a configuration diagram illustrating a gap between a small diameter portion of a press roller and a recording medium.

As shown in FIG. 3, d of Formula (1) denotes the maximum value of the gap between the small diameter portions 202C of the press roller 202 and the paper 122 when the press roller 202 is pressed against the image rendering drum 170 through the paper 122 for cases where the two edge portions of the rotation shaft 202A are bowed in towards the vicinity of the image rendering drum 170.

Width a of the Large Diameter Portion 202B of the Press Roller 202

The inkjet recording apparatus 1 is capable of conveying paper 122 of plural differing widths. The length (width) of the non-nipped area between the small diameter portions 202C of the press roller 202 and the paper 122 is preferably set at 40% to 80% of the paper 122 width. When the length of the non-nipped area between the small diameter portions 202C of the press roller 202 and the paper 122 is smaller than 40% of the paper 122 width, the length for pressing undulations in the paper 122 out towards the small diameter portions 202C side is insufficient, and creases are readily introduced at the training edge portion of the paper 122. When the length of the non-nipped area between the small diameter portions 202C of the press roller 202 and the paper 122 is greater than 80% of the paper 122 width, the pressing range of the paper 122 by the large diameter portion 202B becomes narrow, leading to a tendency for the sides of the paper 122 to lift up.

Namely, as shown in FIG. 2, if the width of the large diameter portion 202B of the press roller 202 is denoted a, the maximum width of the paper 122 for conveying (paper pass) is denoted LM, and the minimum width thereof is denoted Lm, then the following Formula (2) and Formula (3) are satisfied.

$$0.4\times LM\leq LM-a\leq 0.8\times LM \qquad \text{Formula (2)}$$

$$0.4\times Lm\leq Lm-a\leq 0.8\times Lm \qquad \text{Formula (3)}$$

Respective Formula (4) and Formula (5) arise from solving the above:

$$0.2\times LM\leq a\leq 0.6\times LM \qquad \text{Formula (4)}$$

$$0.2\times Lm\leq a\leq 0.6\times Lm \qquad \text{Formula (5)}$$

The range satisfying both of the above is shown by Formula (6)

$$0.2\times LM\leq a\leq 0.6\times Lm \qquad \text{Formula (6)}$$

Preferably a configuration is adopted in which plural press rollers are prepared, and the press roller is changed over according to the width of the paper 122 so as to satisfy the following Formula (7).

$$0.6\times Lm\leq 0.2\times LM \text{ (namely } LM>3\times Lm) \qquad \text{Formula (7)}$$

Figure 6:
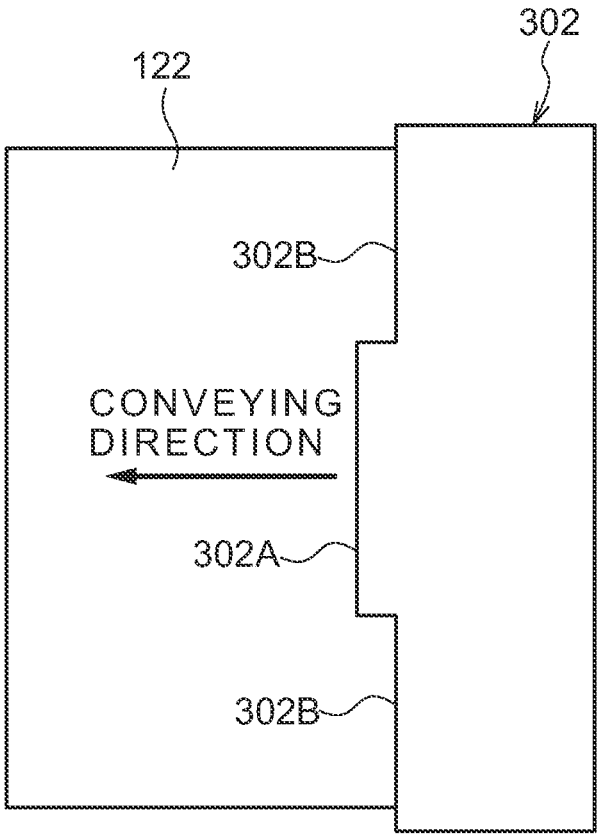
FIG. 6 is a plan view of a warping member serving as a press body according to a modified example.
Figure 7B:
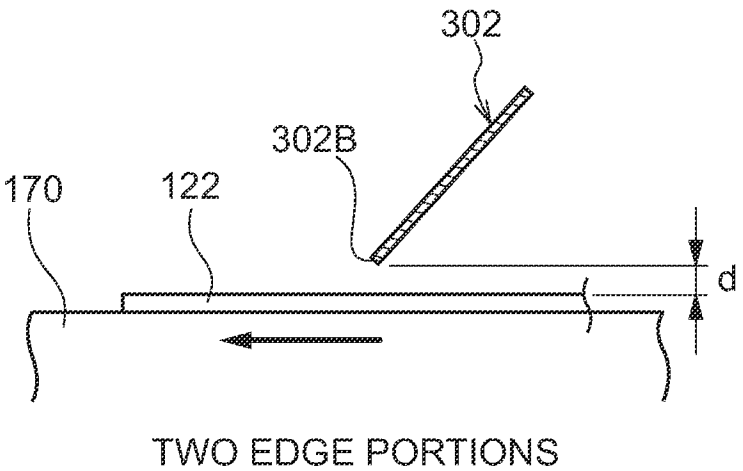
FIG. 7A and FIG. 7B are side views of the warping member shown in FIG. 6, with FIG. 7A being a diagram in which the central portion of the warping member is shown in state pressing a recording medium and FIG. 7B a diagram illustrating the two edge portions of the warping member in a non-contact state to the recording medium.
Figure 7A:
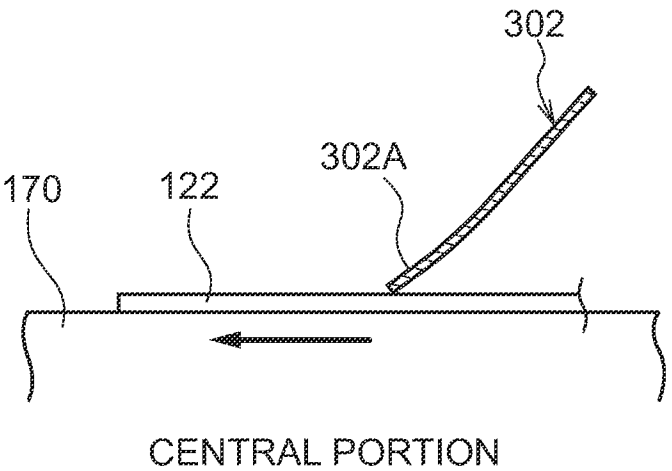

Whilst the press roller 202 has been described as an example in the present exemplary embodiment there is no limitation to a press roller, and configuration may employ a plate shaped warping member (press body) 302 as illustrated in FIG. 6 and FIG. 7A and FIG. 7B. As shown in FIG. 6, the warping member 302 is equipped with a protruding portion 302A formed at the width direction central portion of the warping member 302, and cut out portions 302B formed at the two width direction sides of the protruding portion 302A. The warping member 302 is, for example, formed from a warp-deformable member such as a plastic sheet. As shown in FIG. 7A, the protruding portion 302A of the warping member 302 is warp-deformed and presses only the width direction central portion of the paper 122 against the image rendering drum 170. As shown in FIG. 7B, the cut out portions 302B of the warping member 302 do not press the paper 122, and a gap d is formed between the cut out portions 302B and the paper 122. The warping member 302 also enables lifting to be depressed inwards when lifting up of the paper 122 occurs.

Details Regarding Ink Jetting by the Inkjet Heads 172M, 172K, 172C, 172Y Processing by Image Conversion Section In the inkjet heads 172M, 172K, 172C, 172Y, droplets for an image are spotted corresponding to an input image (ink droplets are jetted onto the paper 122) from plural nozzles (jetting ports), not shown in the drawings. As described above, due to the paper 122 being pre-coated with a processing liquid for reacting with the coloring matter in the ink, the coloring matter in the ink is aggregated and bleeding can be suppressed.

Preferably different image processing processes are performed at the location where the paper 122 is nipped by the large diameter portion 202B of the press roller 202 (the width direction central portion) and at the location where the paper 122 is not nipped (the width direction edge portions). Namely, the degree of aggregation of ink is weakened at the width direction central portion of the paper 122 due to being nipped by the large diameter portion 202B of the press roller 202 resulting in a tendency for the ink dots to be enlarged. This might be due to onward transfer of the processing liquid coated on the paper 122 onto the large diameter portion 202B of the press roller 202. Consequently, in the event that the same image processing to be performed at both locations, the possibility arises of unevenness being visible at the boundary lines between the width direction central portion of the paper 122 (the location nipped by the large diameter portion 202B of the press roller 202) and the width direction edge portions (the non-nipped locations). In order to avoid such a situation arising it is preferable to perform the control as described below.

In the inkjet recording apparatus 1, an image conversion section is provided to a control section, not shown in the drawings, for converting input data into output data. The image conversion section contains two tables of "input (RGB value)→ink amount (CMYK value)", with these two tables corresponding to the width direction central portion of the paper 122 (the location nipped by the large diameter portion 202B of the press roller 202) and the width direction edge portions (the non-nipped locations), respectively.

Figure 4:
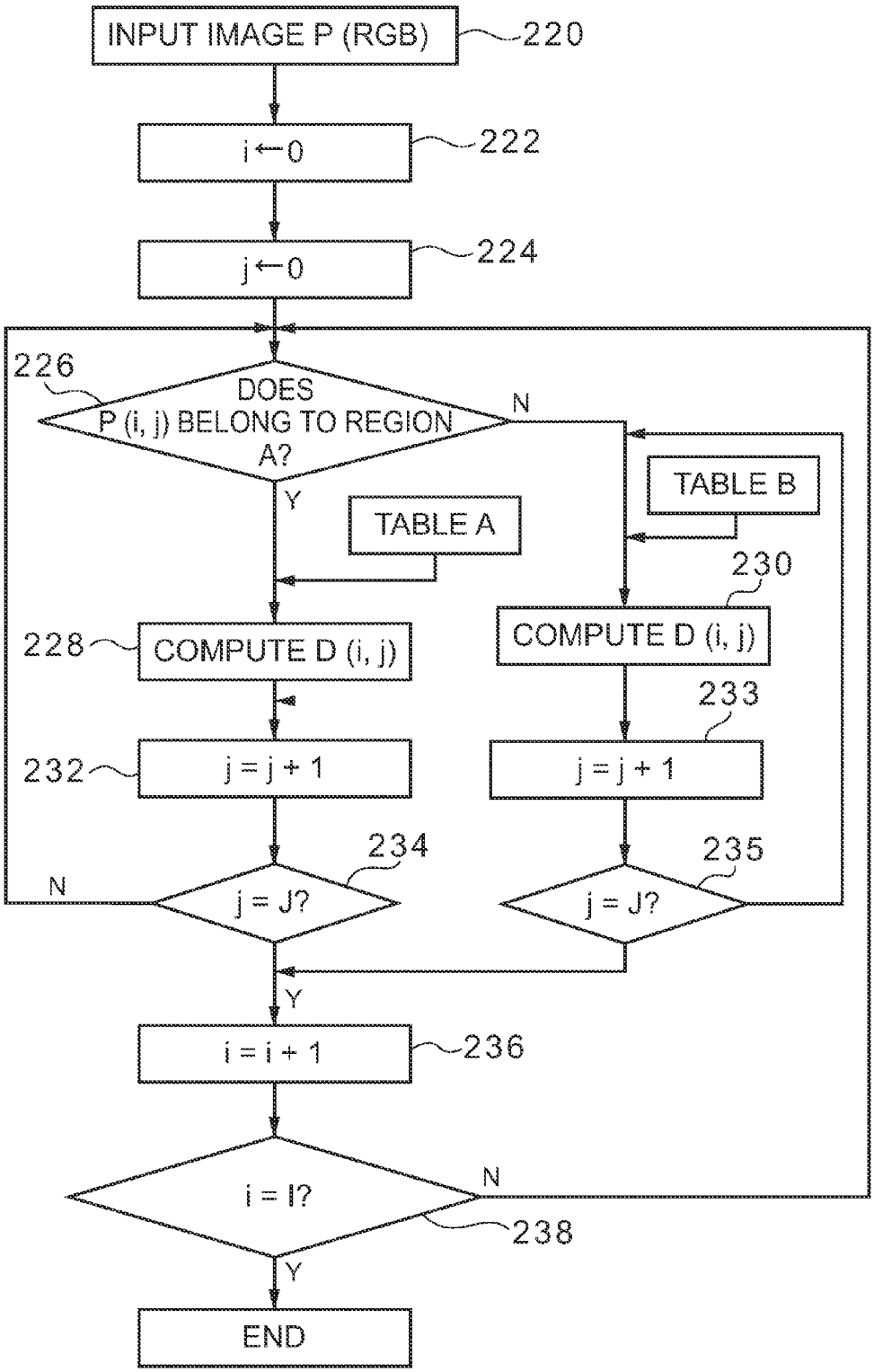
FIG. 4 is a flow chart illustrating a flow of processing in an image conversion section for converting input data into output data.
Figure 5:
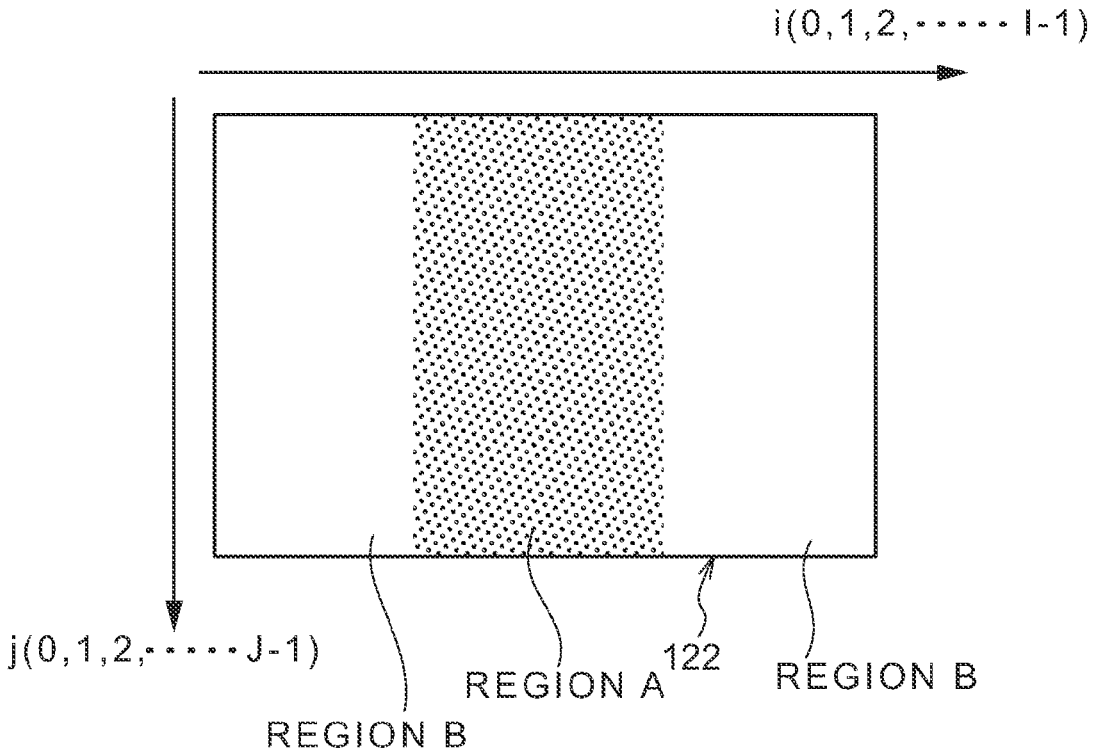
FIG. 5 is a diagram illustrating a region of paper nipped by a press roller and non-nipped regions of the paper.

FIG. 4 is a flow chart illustrating flow of processing in the image conversion section for converting input data into output data. As shown in FIG. 5, region A (a width direction central portion) is the region of the paper 122 nipped by the large diameter portion 202B of the press roller 202, and regions B (two width direction edge portions) is a region of the paper 122 that is not nipped. Tables appropriate to the regions are Table A and Table B, respectively. The width direction coordinate is denoted i (i=0, 1, 2 . . . , I−1), the conveying direction coordinate is denoted j (j=0, 1, 2 . . . , J−1). The ink amount data denoted D (i, j) is data at position (i, j) arising after image conversion through Table A or Table B of input data P (i, j) of an input image. Normally P (i, j) is RGB format data, and D (i, j) is CMYK format data.

As shown in FIG. 4, RGB data is input at step 220 as input image P (i, j). At step 222 the width direction coordinate i is set to 0. At step 224 the conveying direction coordinate j is set to 0. Then, at step 226, determination is made as to whether or not the input image P (i, j) belongs to the region A. When determined to belong to region A an ink amount data D (i, j) is computed as CMYK data by applying Table A at step 228.

Then at step 232 the conveying direction coordinate j is incremented by 1. Then at step 234, determination is made as to whether or not conveying direction coordinate j is J. Processing returns to step 228 when determined that conveying direction coordinate j is not J, and the ink amount data D (i, j) is computed by applying Table A.

When determined at step 226 that the input image P (i, j) does not belong to region A then an ink amount data D (i, j) is computed as CMYK data by applying Table B at step 230.

Then at step 233 the conveying direction coordinate j is incremented by 1. Then at step 235, determination is made as to whether or not conveying direction coordinate j is J. Processing returns to step 230 when determined that conveying direction coordinate j is not J, and the ink amount data D (i, j) is computed by applying Table B.

When conveying direction coordinate j is determined to be J at step 234 or step 235, the width direction coordinate i is incremented by 1 at step 236. Then at step 238 determination is made as to whether or not the width direction coordinate i is I. Processing returns to step 224 and the conveying direction coordinate j is set to 0 when the width direction coordinate i is not I, then determination is made as to whether or not the input image P (i, j) belongs to region A, and processing similar to the above is performed repeatedly. However, processing is ended when the width direction coordinate i is determined at step 238 to be I.

In the present exemplary embodiment, processing is performed such that the ink amount after image conversion for the region A is set at, for example, 90% and the ink amount after image conversion of the regions B is set at, for example, 100%. Accordingly, even though there is a tendency for the ink dots to be enlarged in the region A of the paper 122 where nipped by the large diameter portion 202B of the press roller 202, a visible unevenness at the boundary lines between the region A and the regions B can be suppressed by making the amount of ink in the region A less than the amount of ink in the regions B.

Control of Ink Jetting Amount from the Inkjet Heads

As a separate method, configuration may be made such that the same image processing processes are applied in the region A (width direction central portion) and the regions B (two width direction end portions) of the paper 122, and visible unevenness is reduced by controlling the ink jetting amount from the inkjet heads 172M, 172K, 172C, 172Y.

More specifically configuration may be made, for example, such that the jetting energy (namely the input voltage) for ink from the inkjet heads 172M, 172K, 172C, 172Y is set smaller in the region A (width direction central portion) than in the regions B (two width direction end portions). The ink jetting amount jetted from the inkjet heads 172M, 172K, 172C, 172Y onto the region A of the paper 122 is accordingly made smaller than the ink jetting amount jetted onto the regions B, and the ink dots in the region A are made smaller.

Furthermore, for example, the diameter of the nozzles (jetting ports) of the inkjet heads 172M, 172K, 172C, 172Y is smaller in the region A (width direction central portion) than in the regions B (two width direction end portions). The ink jetting amount from the inkjet heads 172M, 172K, 172C, 172Y onto the region A is accordingly made smaller than the ink jetting amount jetted onto the regions B, making the ink dots in the region A smaller. In such cases, preferably both nozzles (jetting ports) of large diameter and small diameter are provided on the inkjet heads 172M, 172K, 172C, 172Y, so as to enable the nozzle diameter to be varied selectively according to the size of the paper 122. For example, configuration may be made by disposing nozzles (jetting ports) of large diameter and nozzles (jetting ports) of small diameter in parallel rows next to each other on the inkjet heads, such that nozzles for jetting are selected according to the width of the paper 122. Accordingly, appropriate action can be made to change over the press roller to one with a different width of large diameter portion according to the size of the paper 122.

Configuration of the Hot Air Heater 158 and the IR Heaters 160

The hot air heater 158 and the IR heaters 160 are preferably controlled such that the processing liquid of the width direction central portion of the paper 122 is dried more than the two width direction edge portions thereof. Since in the next process only the width direction central portion of the paper 122 is nipped against the image rendering drum 170 by the large diameter portion 202B of the press roller 202, sometimes the processing liquid is onward transferred onto the press roller 202 if drying of the width direction central portion of the paper 122 is insufficient.

Operation and Effect

When printing the back face in two-sided printing, as shown in FIG. 1, the paper 122 is fed out from the paper feed section 110 and conveyed along the outer peripheral faces of the rotating paper feed cylinder 152 and processing liquid drum 154. In the processing liquid application section 112 the recording face (second face) of the paper 122 conveyed along the outer peripheral face of the processing liquid drum 154 is coated with processing liquid by the processing liquid coating device 156.

The paper 122 that has been coated in the processing liquid is then conveyed via the intermediate conveying section 124 and along the outer peripheral face of the image rendering drum 170. In the image rendering section 114 only the width direction central portion of the paper 122 is nipped by the large diameter portion 202B of the press roller 202, and the two width direction edge portions of the paper 122 are not nipped. Accordingly unevenness of the paper 122 is pressed out towards the small diameter portion 202C sides of the press roller 202, thereby suppressing wrinkles and creases in the paper 122 from occurring.

At the paper conveying direction downstream side of the press roller 202 the inkjet heads 172M, 172K, 172C, 172Y jet ink onto the recording face (second face) of the paper 122 being conveyed by the image rendering drum 170, so as to form an image on the paper 122. When the ink makes contact with the processing liquid that was pre-applied to the recording face, the pigment and resin particles dispersed in the ink aggregate, and form aggregation bodies. Conditions such as pigment run on the paper 122 are accordingly prevented, and an image is formed on the recording face of the paper 122.

The paper 122 on which an image has been formed is conveyed via the intermediate conveying section 126 along the outer peripheral face of the drying drum 176. Moisture contained in the paper 122 being conveyed by the drying drum 176 is dried in the drying section 116 by heat from the IR heaters 178 and hot air blown out from the hot air heater 180 (moisture included in the solvent separated by aggregation action is reduced).

The paper 122 that has been heated by the IR heaters 178 and the hot air heater 180 is conveyed via the intermediate conveying section 128 along the outer peripheral face of the fixing drum 184. In the fixing section 118, the image formed on the paper 122 is fixed to the paper 122 by press contact between the fixing drum 184 and the first fixing roller 186 and the second fixing roller 188. The paper 122 then passes through the facing portion of the in-line sensor 190, and a check pattern and such factors as the water content, surface temperature, and glossiness of the paper 122 are measured.

The paper 122 that has been measured by the in-line sensor 190 is then conveyed by the passing cylinder 194 and the conveyor belt 196 and discharged into the discharge tray 192.

In the thus configured inkjet recording apparatus 1, gap d between the small diameter portions 202C of the press roller 202 and the paper 122, and the separation distance Td (throw distance) between the ink jetting face of the inkjet heads 172M, 172K, 172C, 172Y and the surface of the paper 122 satisfy the relationship:

$$0<d<Td \qquad \text{Formula (1)}$$

Accordingly, the two width direction edge portions of the paper 122 pass through the gap d formed at the small diameter portions 202C of the press roller 202, this gap being smaller than the throw distance, and lifting is depressed inwards even when lifting up of the paper 122 of the Td or greater occurs. Accordingly the paper 122 can be prevented from making contact with the ink jetting face of the inkjet heads 172M, 172K, 172C, 172Y in the following process.

As shown in FIG. 2, if the width of the large diameter portion 202B of the press roller 202 is denoted a, the maximum width and the minimum width of the paper 122 for conveying (paper pass) are denoted LM and Lm, respectively then, by satisfying the relationship $$0.2\times LM\leq a\leq 0.6\times Lm \qquad \text{Formula (6)}$$

even when plural types of paper 122 of different width from each other are conveyed, unevenness of the paper 122 is pressed out towards the small diameter portions 202C sides of the press roller 202, and wrinkles and creases can be suppressed from occurring in the paper 122.

As shown in FIG. 4 and FIG. 5, by applying either Table A or Table B different image conversion is performed in the region A of the paper 122 nipped by the large diameter portion 202B of the press roller 202 to conversion performed in the regions B of the paper 122 that is not nipped. For example, processing is performed such that the ink amount after image conversion for the region A is set at 90% and the ink amount after image conversion of the regions B is set at 100%. Accordingly, even though there is a tendency for the ink dots to be enlarged in the region A of the paper 122, unevenness of a formed image at the boundary lines between the region A and the regions B can be suppressed from being visible.

Furthermore, as separated measures configuration may be made, for example, such that the jetting energy (namely the input voltage) for ink from the inkjet heads 172M, 172K, 172C, 172Y is smaller in the region A than in the regions B, or the diameter of the nozzles (jetting ports) of the inkjet heads 172M, 172K, 172C, 172Y is smaller in the region A than in the regions B. By adopting such measures the ink jetting amount jetted from the inkjet heads 172M, 172K, 172C, 172Y onto the region A of the paper 122 is made smaller than the ink jetting amount jetted onto the regions B, enabling the ink dots in the region A to be made smaller.

Evaluation of Condition of the Paper 122 Resulting from the Press Roller 202

Explanation follows regarding evaluation results with respect to the length of nip area on the paper 122 due to the press roller 202 (namely length of the non-nipped areas).

In tests the inkjet recording apparatus 1 is employed for double sided printing, and the condition of the paper 122 during double sided printing is evaluated.

Evaluation is made of the back face of paper which the front face has been printed with a solid print pattern on OK Topcoat paper, manufactured by Oji Paper Company Ltd. The size of the paper is Half Kiku size (636 mm×469 mm). Solid printing is performed here with 1200×1200 individual 5 pL dots of ink per inch square. In tests, the length of nipped area (%) of the paper 122 by the press roller 202 and the length of non-nipped areas (%) are varied as shown in Table 1, and the condition of the paper 122 evaluated. The evaluation results of the paper 122 are shown in Table 1.

TABLE 1

| Length of Nip Area (%) | Length of Non-Nipped Area (%) | | Result |
|---|---|---|---|
| 100 | 0 | Bad | Creases incorporated into trailing edge portion of paper |
| 75 | 25 | Bad | Creases incorporated into trailing edge portion of paper |
| 60 | 40 | Good | Good fixing achievable |
| 20 | 80 | Good | Good fixing achievable |
| 10 | 90 | Bad | Lifting up on both side edges of the paper |

It can be seen from Table 1 that when the length of area (%) of the paper 122 not nipped by the press roller 202 is 40 to 80%, the paper 122 can be conveyed stably adhered to the image rendering drum 170, and creases do not occur at the training edge portion of the paper 122.

While the present invention has been explained above by way of exemplary embodiments, the present invention is not limited by the above exemplary embodiments, and obviously various embodiments may be implemented within a scope not departing from the spirit of the present invention.

For example, while in the above exemplary embodiments explanation has been given of an inkjet image forming apparatus employing water based ink that uses water as the solvent, the liquid jetted is not limited to ink such as for image recording or text printing. The present invention can be applied to various jetting liquids as long as the liquid employs a solvent or a dispersion medium that seeps into a recording medium.

What is claimed is:

1. An image forming apparatus comprising:

a conveying device, comprising:

a conveying body that conveys a recording medium; and a press roller comprising a large diameter portion that is formed at an axial direction central portion of the press roller and makes contact with the conveying body, and small diameter portions formed at both axial direction sides of the large diameter portion with a smaller diameter than the large diameter portion, wherein only a width direction central portion of the recording medium is pressed against the conveying body by the large diameter portion;

a liquid droplet jetting head that is provided at the recording medium conveying direction downstream side of the press roller and jets liquid droplets from a plurality of jetting ports towards the recording medium being conveyed by the conveying body; and an image conversion section that converts input data of an image into output data, and the image forming apparatus satisfies $0<d<Td$, wherein Td is the separation distance between the liquid droplet jetting face of the liquid droplet jetting head and the recording medium and d is the gap between the small diameter portion and the recording medium that is conveyed on the conveying body.

2. The image forming apparatus of claim 1 wherein the conveying body comprises a suction device that suctions a surface of the recording medium.

3. The image forming apparatus of claim 1 further comprising a processing liquid application device that, before the liquid droplets are jetted onto the recording medium by the liquid droplet jetting head, applies to the recording medium a processing liquid that reacts with a component in the liquid droplets.

4. The image forming apparatus of claim 3 further comprising a processing liquid drying device that dries a solvent component of the processing liquid in the interval between when the processing liquid is applied by the processing liquid application device and when the liquid droplets are jetted onto the recording medium by the liquid droplet jetting head.

5. The image forming apparatus of claim 4 wherein the processing liquid drying device is configured to dry a width direction central portion of the recording medium more than it dries two width direction edge portions of the recording medium.

6. The image forming apparatus of claim 3 wherein conversion processing performed by the image conversion section for a region of the central portion of the recording medium pressed by the large diameter portion is different from conversion processing performed for regions of the two edge portions of the recording medium not pressed by the large diameter portion.

7. The image forming apparatus of claim 6 wherein the image conversion section performs conversion processing such that a liquid droplet amount jetted by the liquid droplet jetting head at the region of the central portion is smaller than a liquid droplet amount jetted by the liquid droplet jetting head at the regions of the two edge portions.

8. The image forming apparatus of claim 3 wherein jetting energy of liquid droplets from the liquid droplet jetting head is different at the region of the central portion of the recording medium pressed by the large diameter portion than that at the regions of the two edge portions of the recording medium not pressed by the large diameter portion.

9. The image forming apparatus of claim 8 wherein the liquid droplet jetting head uses a jetting energy for liquid droplets at the region of the central portion smaller than the jetting energy for liquid droplets at the regions of the two edge portions.

10. The image forming apparatus of claim 3 wherein a diameter of liquid droplet jetting ports of the liquid droplet jetting heads at the region of the central portion of the recording medium pressed by the large diameter portion is different from a diameter of liquid droplet jetting ports of the liquid droplet jetting heads at the regions of the two edge portions of the recording medium not pressed by the large diameter portion.

11. The image forming apparatus of claim 10 wherein the liquid droplet jetting heads use a smaller diameter of the liquid droplet jetting ports onto the region of the central portion than the diameter of the liquid droplet jetting ports onto the regions of the two edge portions.

12. The image forming apparatus of claim 10 wherein the liquid droplet jetting head is configured with capability to selectively switch between large diameter jetting ports and small diameter jetting ports.

13. The image forming apparatus of claim 1, wherein the conveying device is capable of conveying a plurality of recording media of different widths and satisfies $$0.2\times LM\leq a\leq 0.6\times Lm,$$

wherein LM is the maximum width of the recording media, Lm is the minimum width of the recording media, and a is the width of the large diameter portion.

* * * * *